United States Patent [19]

Eberhart

[11] 4,105,234

[45] Aug. 8, 1978

[54] LATCH MECHANISM

[76] Inventor: Ray Eberhart, 317 E. Jefferson Blvd., Mishawaka, Ind. 46544

[21] Appl. No.: 792,198

[22] Filed: Apr. 29, 1977

[51] Int. Cl.[2] ..... E05C 13/02

[52] U.S. Cl. ..... 292/302

[58] Field of Search ..... 292/346, 171, 32, 106, 292/150, 121, 109, DIG. 72

[56] References Cited

U.S. PATENT DOCUMENTS

| | | | |
|---|---|---|---|
| 1,192,105 | 7/1916 | Patterson | 292/106 X |
| 2,464,543 | 3/1949 | Modrey | 292/106 |
| 2,499,745 | 3/1950 | Gould | 292/152 X |
| 2,630,005 | 3/1953 | Raivety | 292/150 X |
| 2,668,073 | 2/1954 | Collar et al. | 292/150 X |
| 2,734,764 | 2/1956 | Angelo | 292/171 X |
| 2,917,916 | 12/1959 | Dall | 292/111 X |

*Primary Examiner*—Richard E. Moore
*Attorney, Agent, or Firm*—Marmaduke A. Hobbs

[57] ABSTRACT

A latch mechanism, in which a female portion is provided with a slot having two opposed edges and inner and outer wall surfaces on opposite sides of the slot edges, and a male portion having a member with a forward end and a shoulder thereon for extending through the slot and seating on the inner surface of the female portion. A member movable toward and away from the forward end of the first member is adapted to seat in the slot when the first member is disposed therein, for holding the first member in the slot and the shoulder in engagement with the inner surface of the part defining the slot. The second member includes a lug for positively disengaging the male and female members as the second member is retracted against a spring which urges it toward the forward end of the first member. An operating element, preferably consisting of a lock, push button, handle, wire or stem, is provided for retracting the second member.

10 Claims, 8 Drawing Figures

LATCH MECHANISM

Latch mechanisms used on vehicles must latch easily, hold firmly under substantial and suddenly applied forces, and unlatch fully and immediately when the latch release means is operated. Various types of latch mechanisms have been used in safety belt buckles, these usually being operated by either a pivoted lever which is lifted away from the person's body to unlatch the mechanism, or by a push button in the center of the buckle which is pressed inwardly toward the person's body to depress a lever which unlatches the latch mechanism. Problems are often encountered in constructing the buckles of the foregoing type with sufficient strength and simplicity to be reliable and safe under adverse conditions of operation, including all types of accidents. The conventional push button type safety belt buckle used in automotive vehicles is relatively complicated and requires close tolerances between the operating parts in order to meet minimum safety and reliability standards. These same problems are also present in the fabrication and operation of the latch mechanism of connectors and couplings often used in the tractor, truck and railroad fields, as well as for vehicle doors. It is therefore one of the principal objects of the present invention to provide a latch mechanism for safety buckles, vehicle doors, connectors and couplings, which is simple in construction and operation, and which will operate safely and reliably without strict tolerances being maintained between the operating parts of the mechanism.

The present invention involves a latch mechanism including a female portion having a slot with two opposed edges and an inner and outer wall surface on opposite sides of the edges, and a male portion having a member with a forward end and shoulder for extending through the slot and seating on the inner wall surface of the female portion. A member slidable on the male member slips into the slot after the shoulder has seated on the inner wall surface or other shoulder and locks the male portion in its latched position. This type of mechanism has been found to be a very efffective and reliable latch, particularly for safety belts, and automobile trunk and side door locks; however, when the latch mechanism is used for these enumerated purposes, particularly for safety belts, it is important that the parts immediately disengage when the mechanism is unlatched. In prior latch mechanisms of this type, there has been a tendency for the shoulder of the male portion to hang up on the inner wall shoulder on the female portion, and hence to prevent the male and female portions from separating when they are unlatched. This condition may not only result in an inconvenience but may also create a hazardous situation when the mechanism is used as a safety belt buckle, since it may prevent the occupant from leaving a wrecked vehicle immediately after an accident. It is therefore another primary object of the present invention to provide a latch mechanism of the aforesaid type which positively disengages the male and female portions when the slidable member is retracted in the unlatching operation, and which will quickly latch and unlatch as the slidable member is moved toward and away from the end of the male portion.

Additional objects and advantages of the present invention will become apparent from the following description and accompanying drawings, wherein.

Figure 1:
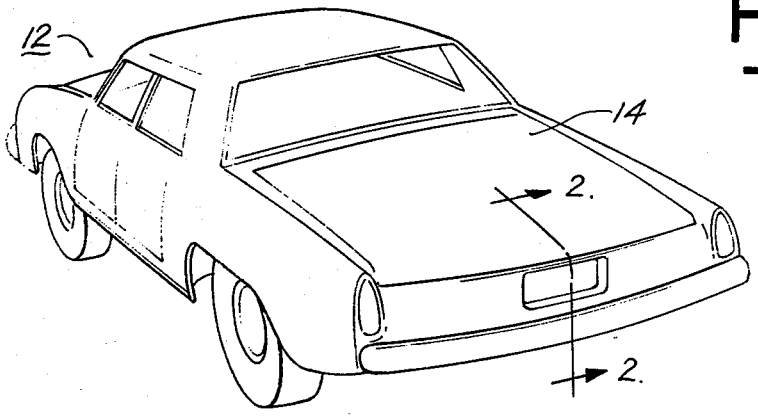
FIG. 1 is a perspective view of an automobile having a trunk door locked by the present latch mechanism.
Figure 2:
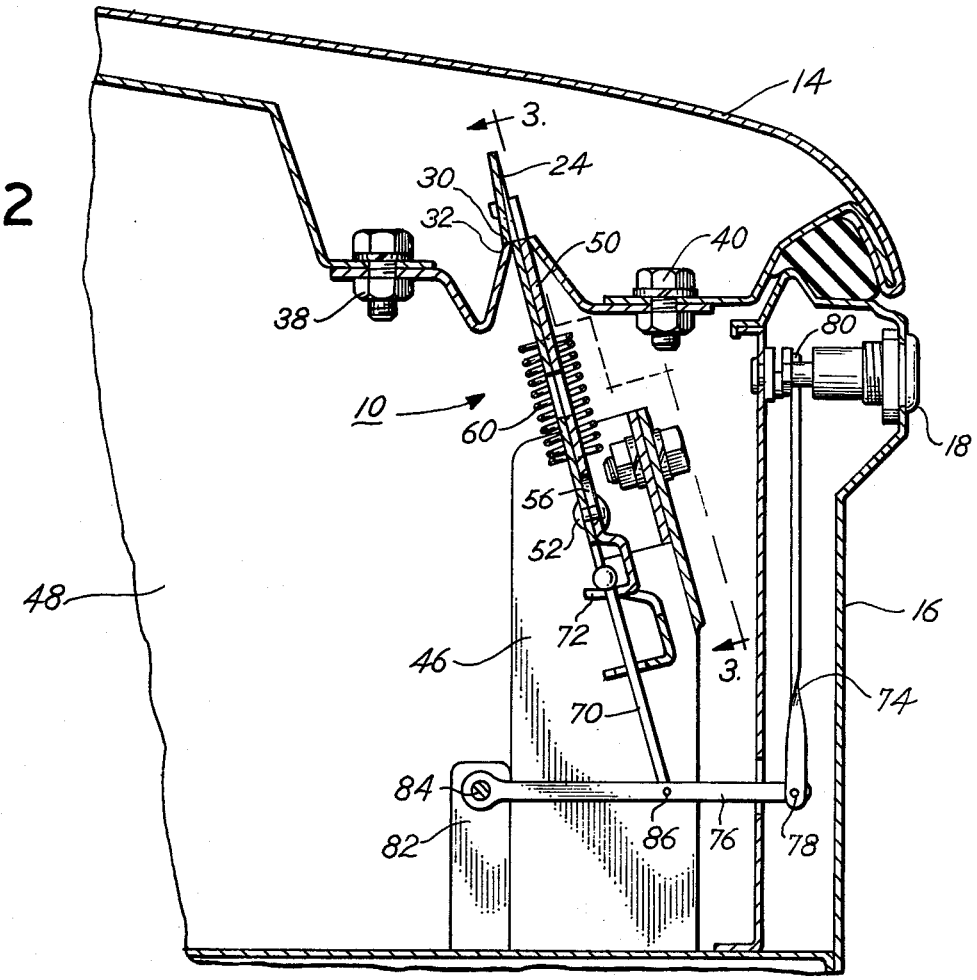
FIG. 2 is an enlarged, fragmentary cross sectional view of the trunk door shown in FIG. 1, the section being taken on line 2 — 2 of the latter figure, showing details of the latch mechanism.
Figure 3:
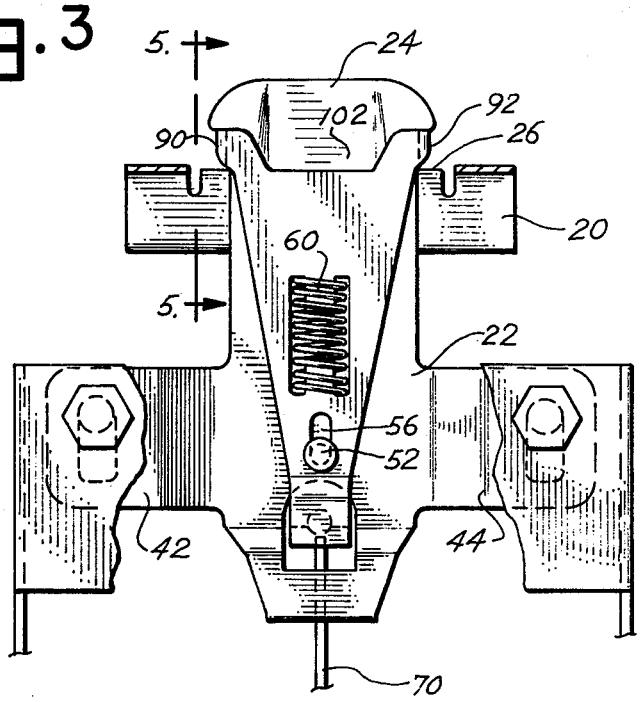
FIG. 3 is a plan view of the latch mechanism shown in FIG. 2, illustrating the mechanism in its latched position.
Figure 4:
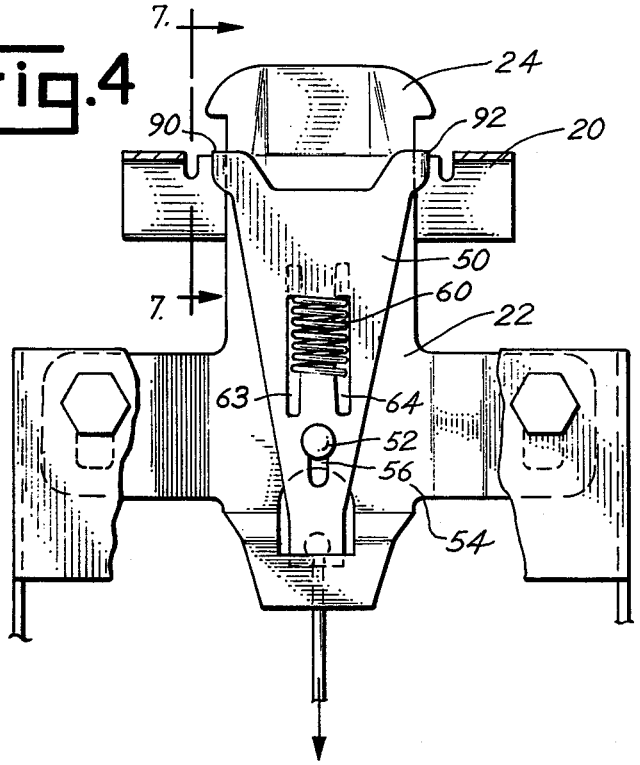
FIG. 4 is a plan view of the latch mechanism, illustrating the latch mechanism in its unlatched position.

Referring more specifically to the drawings, numeral 10 indicates generally the present latch mechanism which is illustrated in FIG. 2 installed in an automobile 12 of FIG. 1 for latching the truck door 14. The latch is mounted behind panel 16 and is controlled by a lock 18 mounted in the panel. The latch mechanism has a variety of different uses, and the embodiment shown in the drawings for locking a trunk door is for illustrative purposes only.

The latch mechanism consists of a female portion 20 and a male portion 22 interlocked by elongated member or tongue 24 on the male portion, which extends through a slot 26 of the female portion. The tongue has a shoulder 30 for engaging and locking behind shoulder 32 when it has been inserted through slot 26. The female portion has flanges 34 and 36 with holes therein for securing the female portion to the trunk door by bolts 38 and 40, and the male portion has flanges 42 and 44 with holes therein for securing the male portion to a frame structure 46 in the rear portion of trunk 48.

A member 50 is slidably mounted on tongue 24 by a rivet 52 secured to the body 54 of male portion 22 and extending through an elongated slot 56 in member 50. With this arrangement the member slides freely on the tongue toward and away from the end thereof when the latch is latched and unlatched. A spring 60 disposed in slots 63 and 64 and reacting between tongue 24 and member 50, constantly urges member 50 forwardly toward the end of the tongue.

Slot 26 is restricted by a lug 62 to a combined thickness of tongue 24 and member 50, both of which are generally flat plate-like members disposed in face-to-face contact with one another. When the tongue has been inserted into slot 26, member 50 cannot enter the slot until after shoulder 30 has seated behind edge or shoulder 32, the size of the shoulder being substantially the same width as the thickness of the tongue. In the embodiment shown, slidable member 50 is retracted from its forward position against the action of spring 60, by a stem 70 connected to a finger 72 formed integrally with member 50. Stem 70 is operated by the action of lock 18 through a linkage consisting of rod 74 and lever 76, the rod and lever being pivotally connected to one another by a pin 78 at the lower end of the rod, and the upper end of the rod being connected to the angularly movable lock operated mechanism 80 at the rear of lock 18. Lever 76 is pivoted to a rigid member 82 by a pin 84 and to the lower end of stem 70 at pivot point 86. When the key is inserted in lock 18 and rotated, rod 74 presses lever 76 downwardly, thus retracting member 50 away from the forward end of tongue 24.

Figure 5:
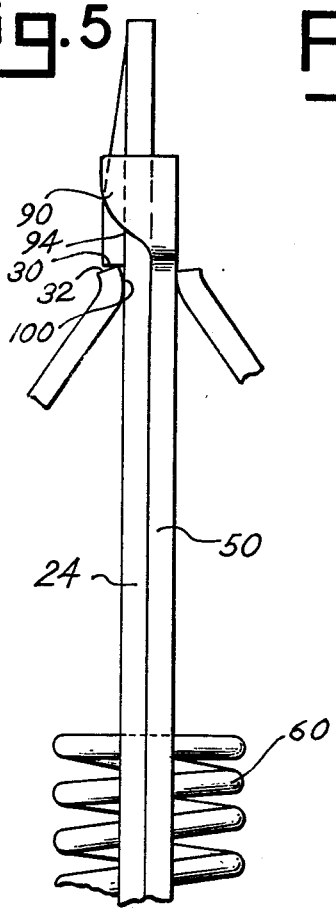
FIGS. 5, 6 and 7 are enlarged fragmentary views, illustrating the manner in which the present latch mechanism operates.
Figure 6:
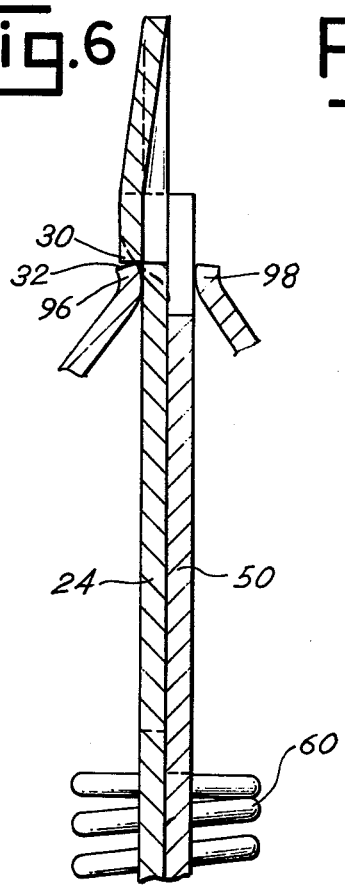
Figure 7:
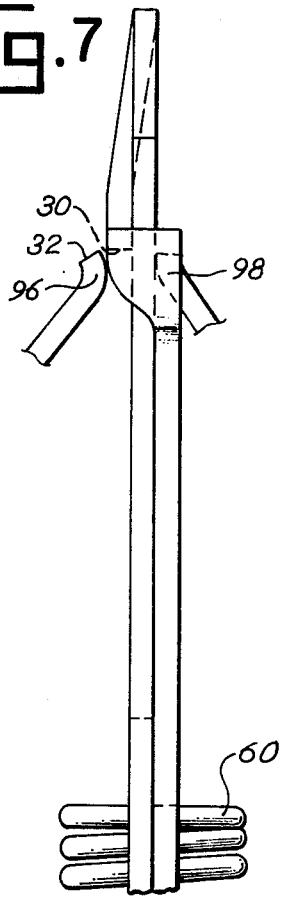
Figure 8:
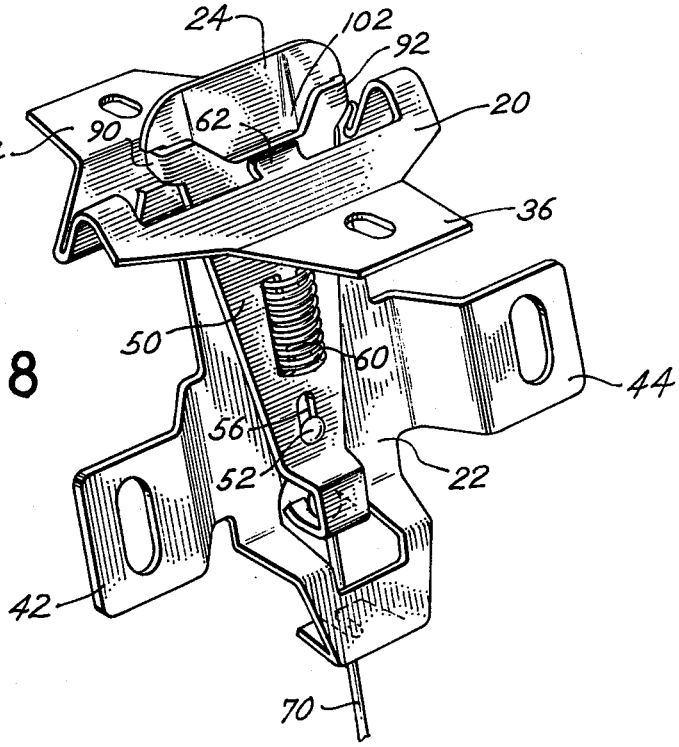
FIG. 8 is a perspective view of the latch mechanism shown in the preceding figures with the mechanism in latched position.

One of the primary difficulties in latches of this type in the past has been the unreliability of interlocking shoulders 30 and 32 to become disengaged when a member such as member 50 is retracted from the slot to unlock the latch. The present latch mechanism overcomes this difficulty and avoids creating a hazardous condition when the latch mechanism is used for seat belts, in that it positively releases the safety belt when the latch is unlatched in an emergency. This is accomplished by the provision of positively disengaging lugs 90 and 92 on opposite sides of member 50 near the forward end thereof. These lugs are each provided with a cam surface 94 which engages shoulder 32 or the edge of the structure defining slot 26, as illustrated in FIG. 6. As the member 50 moves away from the restraining effect of lug 62, the cam surfaces of lugs 90 and 92 positively push the tonque toward the opposite side of slot 26, thereby disengaging shoulder 30 from shoulder 32 so that the tongue can easily slip from the slot. Sides 96 and 98 defining slot 26 are preferably arcuate, as can best be seen in FIGS. 5 through 7, to permit the cam surface 94 to easily slide over side 96, thereby facilitating disengagement of the two shoulders.

In order to correlate accurately the release of member 50 from slot 26 as lugs 90 and 92 engage the shoulder 32 or the side 90, a slot 102 is provided in the end of member 50 so that as the member is retracted, lug 62 no longer restrains the tongue laterally when the lugs initially become effective to disengage the shoulders. While lug 62 is illustrated as defining the critical size of slot 26, the lug may be an edge extending from one end of the slot to another. With this construction, the lugs must extend from the lower portion of member 50 so that they will not interfere with the movement of the tongue away from side 96 toward side 98 as the lugs 90 and 92 perform the shoulder disengaging operation.

In the operation of the latch mechanism illustrated in the drawings, when the trunk door 14 of the automobile is moved toward closed, tongue 24 extends through slot 26 and, when the forward end of member 50 engages side 98 of the slot, it is held in fixed position while the tongue proceeds forwardly through the slot to the point where shoulder 30 will engage shoulder 32. At this point the tongue moves toward side 96, thus permitting the two shoulders to interlock with one another. When this takes place, member 50, under the pressure of spring 60, then slides into the slot 26, thereby locking the male and female portions together.

When the trunk door is to be opened, the key is inserted in lock 18 and rotated, thereby moving rod 74 downwardly, pivoting rod 76 downwardly and pulling stem 70 downwardly. Since stem 70 is firmly connected to member 50, the member is retracted away from the forward end of tongue 24 and, when the edge of slot 102 passes the free edge of lug 62, cams 94 on the two lugs 90 and 92 engage shoulder 32 or the edge of slot 26, thereby forcing the tongue away from side 96 toward side 98 of slot 26. Member 50 is retracted sufficiently to cause lugs 90 and 92 positively to move shoulder 30 to the point where it no longer interlocks with shoulder 32. With the two shoulders disengaged, tongue 24 slips unrestricted from slot 26, thereby separating the male and female portions and permitting the trunk door to open fully. Since spring 60 constantly urges member 50 toward the forward end of tongue 24, member 50 is returned to the position where the trunk door can be latched merely by closing the door to the point where tongue 24 extends through the slot 26. As it moves forwardly through slot 26, member 50, as explained previously, is initially retracted against the force of spring 60 until shoulder 30 can move laterally toward side 96 to the position where it is interlocked with shoulder 32. When the tongue has reached this position, member 50 can move forwardly into slot 26, thereby locking the two shoulders in fully engaged and locked position.

It is thus seen that a positive disengaging feature and function have been incorporated in a relatively simple latching mechanism, thus assuring that the latch will become unlatched when member 50 is retracted from slot 26 as the lock mechanism is operated. This feature is important in most applications of the lock, in that it permits the use of effective interlocking abrupt shoulders, such as shoulders 30 and 32, obtaining a firm positive engagement between the two interlocking shoulders. The latch mechanism embodying the present invention has many applications, including the use in railroad car couplings, on farm and industrial equipment, and the mechanism may be electrically, pneumatically and mechanically operated. The latch mechanism may also be operated from a place remote from the latch, through electrical circuitry, an air line or a pushpull cable.

While only one embodiment of the present latch mechanism has been described in detail herein, various changes and modifications may be made without departing from the scope of the invention.

I claim:

1. A latch mechanism comprising a female portion having a means defining a slot with two opposed edges and a shoulder on the inner side of the slot, a male portion having a first member with a forward end movable into and from said slot and a shoulder thereon for engaging and interlocking with said first mentioned shoulder, and a second member connected to said first member and being movable toward and away from the forward end of said first member and into and from said slot when said first member is disposed therein and said shoulders are in engagement with one another, and means movable with said second member for disengaging said shoulders from one another when said second member is withdrawn from said slot.

2. A latch mechanism as defined in claim 1 in which said means movable with said second member for disengaging said shoulders includes a lug on said second member for engaging a part on said female portion to urge said two shoulders apart.

3. A latch mechanism as defined in claim 1 in which the means on said second member for disengaging the shoulders includes two spaced lugs having a tapered cam surface for engaging a part on said female portion to urge said shoulders apart as said second member is withdrawn from said slot.

4. A latch mechanism as defined in claim 1 in which said first and second members are in slidable contact with one another and a resilient means urges said second member toward the forward end of said first member.

5. A latch mechanism as defined in claim 3 in which said first and second members are in slidable contact with one another and a resilient means urges said second member toward the forward end of said first member.

6. A latch mechanism as defined in claim 2 in which an operating means is attached to said second member for moving said second member away from the forward end of said first member.

7. A latch mechanism as defined in claim 1 in which said members are plate-like in construction and said second member slides on said first member, and means is attached to said second member to withdraw said second member away from the forward end of said first member.

8. A latch mechanism as defined in claim 2 in which said members are plate-like in construction and said second member slides on said first member, and an operating means is attached to said second member to withdraw said second member away from the forward end of said first member.

9. A latch mechanism as defined in claim 8 in which a resilient means constantly urges said second member toward the forward end of said first member.

10. A latch mechanism as defined in claim 9 in which said operating means consists of a wire attached to said second member and having an operating means remotely disposed with respect to said latch mechanism.

* * * * *